US006573810B2

(12) United States Patent
Cayrou et al.

(10) Patent No.: US 6,573,810 B2
(45) Date of Patent: Jun. 3, 2003

(54) DEVICE FOR TRANSMITTING ELECTROMAGNETIC SIGNALS ACROSS A STRUCTURE INCLUDING MODULES ORGANIZED FOR TWO-FOR-ONE REDUNDANCY

(75) Inventors: Jean-Christophe Cayrou, Agen (FR); Patrice Ulian, Latrape (FR); Gaëlle Jarthon, Toulouse (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/898,065

(22) Filed: Jul. 5, 2001

(65) Prior Publication Data

US 2002/0030553 A1 Mar. 14, 2002

(30) Foreign Application Priority Data

Aug. 10, 2000 (FR) ..... 00 10527

(51) Int. Cl.[7] ..... H01P 1/213; H01P 5/12

(52) U.S. Cl. ..... 333/135; 333/124; 333/137; 333/101

(58) Field of Search ..... 333/101, 248, 333/26, 21 A, 21 R, 122, 125, 135, 137

(56) References Cited

U.S. PATENT DOCUMENTS 4,761,625 A * 8/1988 Sharma ..... 333/209
5,083,094 A 1/1992 Forsberg
5,376,901 A * 12/1994 Chan et al. ..... 333/33
5,517,203 A * 5/1996 Fiedziuszko ..... 343/756
6,081,170 A * 6/2000 Enokuma ..... 333/134
6,154,181 A * 11/2000 Hu-Guo et al. ..... 343/772
6,297,714 B1 * 10/2001 Hirtzlin et al. ..... 333/135
6,392,508 B1 * 5/2002 Damphousse et al. ..... 333/209

FOREIGN PATENT DOCUMENTS

| | | | | |
|---|---|---|---|---|
| GB | 1 507 147 | | 4/1978 | |
| JP | 61018204 | | 1/1986 | |
| JP | 63-051702 | * | 3/1988 | ..... H01P/1/207 |
| JP | 08084001 | | 3/1996 | |

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

A device for transmitting electromagnetic signals across a structure including functional modules organized so that two-for-one redundancy is obtained, in the case of signals that are transmitted by electromagnetic waveguides, includes a waveguide, an input end of which receives signals intended to be fed to one or the other of two functional modules organized so that two-for-one redundancy is obtained, and the other end of which is short circuited. It includes two electric field sampling units, each of which is adapted to feed one of the modules and which are disposed at respective distances from the short circuited end of the waveguide that are equal to one quarter of the wavelength of the signals transmitted by the waveguide or an odd number multiple thereof. Each module has an output connected to a single-pole switch or combiner transmitting signals from either or both of the two modules downstream of the device.

6 Claims, 1 Drawing Sheet

DEVICE FOR TRANSMITTING ELECTROMAGNETIC SIGNALS ACROSS A STRUCTURE INCLUDING MODULES ORGANIZED FOR TWO-FOR-ONE REDUNDANCY

CROSS-REFERENCE TO RELATED APPLICATIONS

This application is based on French Patent Application No. 00 10 527 filed Aug. 10, 2000, the disclosure of which is hereby incorporated by reference thereto in its entirety, and the priority of which is hereby claimed under 35 U.S.C. §119.

BACKGROUND OF THE INVENTION

1. Field of the invention

The invention relates to a device for transmitting electromagnetic signals across a structure including functional modules organized so that two-for-one redundancy is obtained.

The device is intended to be integrated into the equipment units of a system in which signals are transmitted by means of electromagnetic waveguides, for example in communication equipment units on board satellites. In the present context the expression "electromagnetic waveguides" means waveguides proper and functionally equivalent propagative hardware connections, for example microstrip lines.

2. Description of the prior art

For security reasons, equipment units for on board satellites include functional modules that are duplicated so that failure of one module can be remedied by switching on an identical or similar module that duplicates it.

This kind of redundancy is known as two-for-one redundancy and is conventionally applied to various modules included in an equipment unit, for example amplifier modules which operate on signals transmitted via waveguides.

FIG. 1 is a diagram showing one example of a prior art device made up of identical functional modules enabling two-for-one redundancy to be obtained. The device is designed for use in an equipment unit in which signals are transmitted via electromagnetic waveguides. The device shown includes two identical modules 1 and 1', each of which consists of an amplifier, for example, and the modules are mounted in the device so that they can receive a signal, for example a microwave signal, at an input IN of the device that is connected to the two modules in the equipment unit, not shown here, that incorporates them.

Each of the two modules 1 and 1' in the equipment unit is adapted to supply an identical signal to an output OUT of the device derived from the signal that it receives at the input IN.

A switch 2 is inserted between the input IN and inputs 11 and 11' of each module. The switch is conventionally a single-pole double-throw (SPDT) switch for selectively connecting the input IN to one or other of the inputs 11 and 11'. The modules 1 and 1' each have a signal output O1 or O1' which is connected to the output OUT of the device via a coupler, for example a single-pole switch 3, configured in the opposite way to the switch 2, for selectively connecting the output OUT to one or the other of the two outputs O1, O1'.

FIG. 2 shows a variant of the prior art device shown in FIG. 1. This variant of the device differs from the previous one in that it includes a Wilkinson circuit substituting a combiner 4 for the single-pole switch previously provided between the outputs of the duplicated modules 1, 1' and the output OUT of the device. The combiner 4 includes a resistor 5 inserted between the respective outputs O1 and O1' of the modules 1 and 1'. This is known in the art.

Both the devices shown transmit electromagnetic signals by means of electromagnetic waveguides across a structure including functional modules organized so that two-for-one redundancy is obtained. These devices have the drawback of being bulky, especially if the wavelengths of signals in the target range of wavelengths are relatively high. Moreover, the presence, in addition to the modules, of two switches or of one switch and a combiner complicates incorporating the modules into the same structure. It also complicates testing devices made in this way. This is a major disadvantage, in particular in the case of devices intended for use in equipment units on board satellites, where space is restricted and simple solutions are required for maximum reliability. The invention therefore proposes a device for transmitting electromagnetic signals via electromagnetic waveguides across a structure including functional modules organized so that two-for-one redundancy is obtained.

SUMMARY OF THE INVENTION

The invention provides a device for transmitting electromagnetic signals across a structure including functional modules organized so that two-for-one redundancy is obtained, in the case of signals that are transmitted by electromagnetic waveguides, which device includes a waveguide, an input end of which receives signals intended to be fed to one or the other of two functional modules organized so that two-for-one redundancy is obtained, and the other end of which is short circuited, and which includes two electric field sampling units, each of which is adapted to feed one of the modules and which are disposed at respective distances from the short circuited end of the waveguide that are equal to one quarter of the wavelength of the signals transmitted by the waveguide or an odd number multiple thereof, wherein each module has an output connected to a single-pole switch or combiner transmitting signals from either or both of the two modules downstream of the device.

In one embodiment of the invention the two sampling units are plungers having conductive rods that penetrate to the interior of the waveguide via holes formed in the wall of the waveguide, are coplanar and at respective distances from the short circuited end of the waveguide that correspond to one quarter of the wavelength of the electromagnetic signals that the waveguide transmits and to an odd number multiple of one quarter of the wavelength.

In a preferred embodiment the distance between the sampling units along the waveguide is equal to half the wavelength of the electromagnetic signals transmitted by the waveguide.

A different embodiment of the device includes a selective filter in the waveguide that divides it into two cavities in the part of the waveguide that is closed off by a short circuit component, and the filter can be a finned line filter.

In one embodiment of the device according to the invention the modules are formed simultaneously on the same substrate on which they are connected to the plunger rods of the sampling units by microstrip connections.

The invention, its features and its advantages are explained in the following description, which is given with reference to the following drawings.

DETAILED DESCRIPTION OF THE PREFERRED EMBODIMENT

Figure 3:
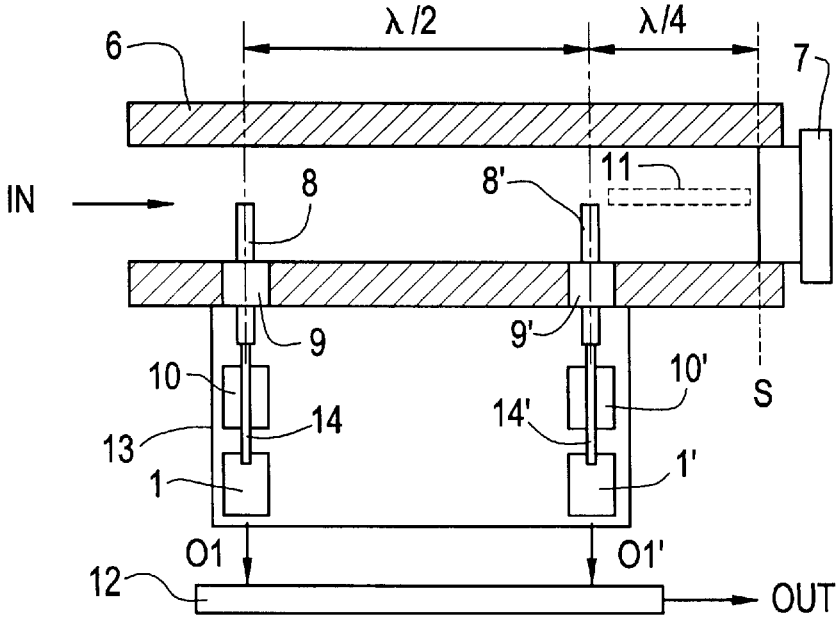
FIG. 3 shows one example of a device in accordance with the invention.

The device in accordance with the invention transmits electromagnetic signals which reach it at an input end IN of a waveguide 6, shown in section in FIG. 3, to one or the other of two functional modules 1 and 1'. The modules are amplifiers, for example, as before. The end of the waveguide 6 opposite its input IN is short circuited by a component 7 that blocks off that end. This is known in the art. In accordance with the invention, two electric field sampling units 8 and 8' are provided to transmit separately to each of the modules 1 and 1' electromagnetic signals that are transmitted to the waveguide 6 via its input IN. The sampling units are provided to avoid the need for a single-pole switch upstream of the modules 1 and 1' to receive the electromagnetic signals that appear at the input IN. In a preferred embodiment, a waveguide-microstrip transition is provided for transmitting to each module signals reaching the waveguide via the input IN. In this example the sampling units 8 and 8' are identical plungers in the form of conductive rods penetrating to the interior of the waveguide 6 through holes in the wall of the waveguide. The plunger rods are immobilized by respective glass beads 9 and 9' which are fixed to the wall and each of which hold one rod.

The rod of the first sampling unit 8' is positioned at a particular distance from the interior surface S of the short circuit component 7 that shuts off the waveguide by means of the bead that it carries. That particular distance is preferably made equal to one quarter of the wavelength $\lambda$ of the electromagnetic signals that the waveguide must transmit to the module 1'. It can be adjustable as a function of the application, for example by operating on a variable capacitor in a filter inserted into the waveguide in the vicinity of the short circuited end of the waveguide.

The aforementioned particular distance can also be an odd multiple of $\mu/4$; the shortest distance is preferably chosen to make the device compact.

The rod of the second sampling unit 8 is positioned in the same plane as the rod of the sampling unit 8' and at a distance from the surface S that is an odd multiple of $\mu/4$, also chosen to be as small as possible (i.e. equal to 3), to obtain a compact device, as already mentioned. The distance between the sampling units along the waveguide is then equal to half the wavelength of the electromagnetic signals transmitted by the waveguide.

In this case, the two sampling units are adapted to capture the electric field present in the waveguide at a level where that field is at a maximum.

Two microwave interfaces 10, 10' are inserted between the sampling units 8 and 8' and the modules 1 and 1' that the units feed with signals. In this example the interfaces are microwave integrated circuit (MIC) interfaces and the modules are low-noise amplifiers (LNA), and the amplifiers are connected by microstrip connections 14, 14' to the rods of the plungers of the sampling units. The whole of the device is preferably implemented on a common substrate 13, which enables simultaneous mounting of the amplifiers and favors testing them in parallel. An important saving is obtained in terms of the overall size of the device including this kind of system.

During operation under nominal conditions one of the amplifiers 1 or 1' is activated and the other one is turned off. The presence of the amplifier that is turned off must not interfere with the field in the waveguide 6, and this can be achieved by inserting a simple switch between at least one of the glass beads and one of the two amplifiers 1, 1', for example in the corresponding interface 10 or 10'. It is also possible to quantify and correct the mutual influence of the two amplifiers 1 and 1', so that the signals coming from the input IN of the waveguide all reach the amplifier that is active at the time. It is then possible to achieve operation with minimum losses.

In the event of failure of the active amplifier, the amplifier that until then has been idle is activated, after removing the power supply from the failed amplifier.

Figure 1:
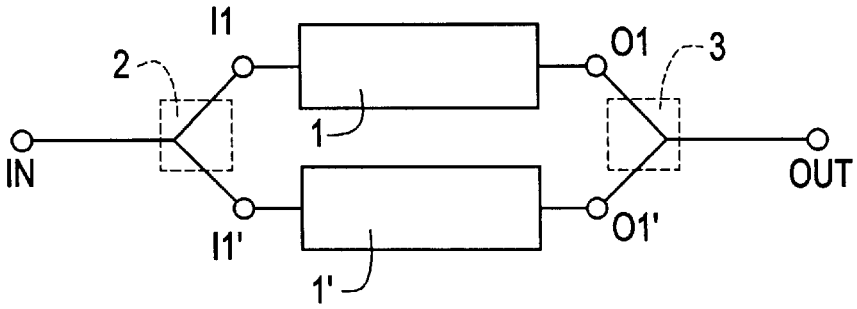
FIG. 1 PRIOR ART
FIGS. 1 and 2 are representations of two prior art devices in which functional modules of an equipment unit enable two-for-one redundancy to be obtained.
Figure 2:
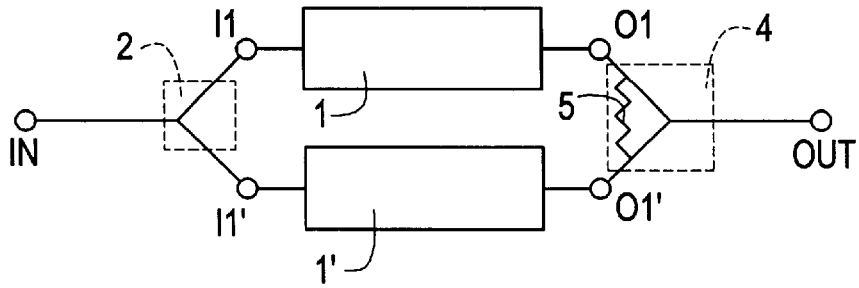
FIG. 2 PRIOR ART

Each of the amplifiers has an independent output, O1 for the amplifier 1 and O1' for the amplifier 1'. The output signals produced by these amplifiers are fed to a combiner 12, for example a single-pole double-throw switch, functionally equivalent to the switch 3 referred to in connection with FIG. 1. The combiner, not shown, can also be functionally equivalent to the combiner 4 referred to in connection with FIG. 2.

Inserting a filter 11 into the waveguide part that the short circuit component 7 shuts off can also be envisaged, to make the resulting device selective. The filter 11 is a finned line filter, for example, whose electrical length is equivalent to $(2N+1)\lambda/4$. It is made on a plane substrate dividing the waveguide section into two cavities, in which it extends longitudinally. This embodiment provides a high Q and consequently low losses.

There is claimed:

1. A device for transmitting electromagnetic signals across a structure including:

functional modules organized so that two-for-one redundancy is obtained, in the case of signals that are transmitted by electromagnetic waveguides, a waveguide, an input end of which receives signals intended to be fed to one of two functional modules organized so that two-for-one redundancy is obtained, and an other end of which is short circuited, and two electric field sampling units, each of which is adapted to feed one of said modules from said input end and which are disposed at respective distances from said short circuited end of said waveguide that are equal to one quarter of the wavelength of the signals transmitted by said waveguide or an odd number multiple thereof, wherein each of said modules has an output connected to a single-pole switch or combiner transmitting signals from either or both of said two modules downstream of said device.

2. The device claimed in claim 1 wherein said two sampling units are plungers having conductive rods that penetrate to the interior of said waveguide via holes formed in the wall of said waveguide, are coplanar and at respective distances from said short circuited end of said waveguide that correspond to one quarter of the wavelength of the electromagnetic signals that said waveguide transmits and to an odd number multiple of one quarter of said wavelength.

3. The device claimed in claim 1 wherein said distance between said sampling units along said waveguide is equal to half the wavelength of said electromagnetic signals transmitted by said waveguide.

4. The device claimed in claim 3 including a selective filter in said waveguide at said input end that divides it into two cavities in a part of said waveguide that is closed off by a short circuit component.

5. The device claimed in claim 4 wherein said filter in said part of said waveguide that is closed off by said short circuit component is a finned line filter.

6. The device claimed in claim 2 wherein said modules are formed simultaneously on a common substrate on which they are coupled to said plunger rods of said sampling units by microstrip connections.

* * * * *